US005937671A

United States Patent [19]

Inoue et al.

[11] Patent Number: 5,937,671

[45] Date of Patent: Aug. 17, 1999

[54] LIQUID TANK

[75] Inventors: Seiji Inoue; Akihiko Takano, both of Saitama Prefecture, Japan

[73] Assignee: Zexel Corporation, Japan

[21] Appl. No.: 08/965,731

[22] Filed: Nov. 7, 1997

[30] Foreign Application Priority Data

| | | | |
|---|---|---|---|
| Nov. 8, 1996 | [JP] | Japan | 8-311170 |
| Apr. 18, 1997 | [JP] | Japan | 9-115036 |
| Apr. 23, 1997 | [JP] | Japan | 9-118629 |

[51] Int. Cl.[6] ..... F25B 39/04

[52] U.S. Cl. ..... 62/509; 96/206

[58] Field of Search ..... 62/509; 96/204, 96/206; 210/188

[56] References Cited

U.S. PATENT DOCUMENTS

| | | | |
|---|---|---|---|
| 4,061,031 | 12/1977 | Grimsrud | 73/200 |
| 4,341,092 | 7/1982 | Davis | 62/475 |
| 4,475,932 | 10/1984 | Hull et al. | 55/170 |
| 5,240,115 | 8/1993 | Crossley | 209/211 |
| 5,419,141 | 5/1995 | Burk | 62/474 |
| 5,429,595 | 7/1995 | Wright, Jr. et al. | 604/9 |

FOREIGN PATENT DOCUMENTS

| | | |
|---|---|---|
| 61-195256 | 8/1986 | Japan . |
| 2-71067 | 3/1990 | Japan . |
| 2-267478 | 11/1990 | Japan . |
| 3-27573 | 3/1991 | Japan . |
| 4-103973 | 4/1992 | Japan . |
| 5-66074 | 3/1993 | Japan . |
| 6-14870 | 2/1994 | Japan . |
| 8-183325 | 7/1996 | Japan . |

*Primary Examiner*—William E. Tapolcai
*Attorney, Agent, or Firm*—Ostrolenk, Faber, Gerb & Soffen, LLP

[57] ABSTRACT

A liquid tank used in an air-conditioning system to remove air and water from refrigerant received from a condenser 8 before passing it to an evaporator 11 comprises a tank body, a refrigerant inlet port and a refrigerant outlet port. In a first aspect of the invention which ensures excellent air-liquid separation, easy assembly, low cost, simple structure and ready mounting on the condenser 8, the refrigerant inlet port section 33 is formed at a lower portion of the tank body 31, the refrigerant outlet port section 34 is formed below the refrigerant inlet port section 33 and a cylindrical partition 32 is provided at a lower portion of the tank body 31 to stand higher than the refrigerant inlet port section 33 and define between itself and the inner wall of the tank body 31 an induction space 35 into which the refrigerant inlet port section 33 opens and define therein a liquid pooling space 36 with which the refrigerant outlet port section 34 communicates. In a second aspect of the invention which provides a degree of freedom in positioning the refrigerant outlet port, facilitates tubing and component layout, keeps cost down and ensures excellent assembly and fabrication property, the refrigerant inlet port 6 and the refrigerant outlet port 7 are formed in a head section 3 closing an upper opening of the tank body 2, a refrigerant takeoff tube 5 is disposed along the axis of the tank body 2, a large-diameter port 72 encompassing the refrigerant outlet port 7 is formed on an inner side of the head section 3, and the refrigerant takeoff tube 5 and the large-diameter port 72 are connected by a joint 71. In a third aspect which provides similar advantages, the refrigerant outlet port 7 is disposed at the center of the head section 3 and multiple refrigerant inlet ports 6 are disposed around the refrigerant outlet port 7.

8 Claims, 13 Drawing Sheets

LIQUID TANK

BACKGROUND OF THE INVENTION

1. Field of the Invention

This invention relates to a liquid tank, more particularly to a liquid tank installed in the refrigeration cycle of an air-conditioning system.

2. Background Art

The general purpose of the liquid tank (receiver/drier) of an air-conditioning system is to temporarily store refrigerant from the condenser and to effect air-liquid separation and removal of water from the refrigerant. In recent years, various innovations have been directed to reducing the diameter of the liquid tank so as to incorporate it in, or make it a subassembly of, the condenser.

An example of this is seen in the conventional liquid tank 1 shown schematically in the vertical sectional view of FIG. 14. This liquid tank 1 has a tank body 2, a head section 3 of flat type, desiccant 4 and a refrigerant takeoff tube 5.

The tank body 2, which is a slender cylinder tapered downward and closed at the bottom, is configured to hold the desiccant 4 at its middle section and refrigerant R at its bottom section.

The head section 3 closes the upper opening of the tank body 2 and is formed with a refrigerant inlet port 6 and a refrigerant outlet port 7. The refrigerant inlet port 6 can be connected to an outlet side tank 9 of a condenser 8 and the refrigerant outlet port 7 to the evaporator 11 side through an expansion valve 10.

The desiccant 4 absorbs and removes water entrained by the refrigerant R. The refrigerant R passes through the desiccant 4 and is pooled in the bottom section of the tank body 2, from where it passes out of the liquid tank 1 (in the direction of the expansion valve 10 and the evaporator 11) through the coolant takeoff tube 5.

In the liquid tank 1 of this configuration, the head section 3 is formed to a smaller diameter and greater height than in earlier liquid tanks of this type and is mounted on the outlet side tank 9 of the condenser 8 by a bolt 12. This structure does not differ greatly from that of earlier liquid tanks and provides only limited cost merit.

FIG. 15 is a vertical sectional view schematically showing another conventional liquid tank. The liquid tank 13 shown here has its refrigerant inlet port 6 at the upper portion of the tank body 2 and its refrigerant outlet port 7 at the lower portion thereof. The refrigerant R flows straight through the tank body 2 from the refrigerant inlet port 6 to the refrigerant outlet port 7.

The cost of the liquid tank 13 is increased by the need to form the refrigerant inlet port 6 and the refrigerant outlet port 7 at separate portions. Moreover, since the refrigerant inlet port 6 and the refrigerant outlet port 7 are widely separated, an attempt to mount the liquid tank 13 directly on the condenser 8 encounters problems when, for example, a condenser 8 utilizing the subcooling structure is adopted, because it becomes difficult to secure the required pitch of the connection portions at the inlet and outlet for returning the refrigerant R to the condenser 8.

FIG. 16 is a vertical sectional view schematically showing still another conventional liquid tank. The liquid tank 14 shown here has both the refrigerant inlet port 6 and the refrigerant outlet port 7 provided at the lower portion of the tank body 2 and is directly mounted on the outlet side tank 9 of the condenser 8.

Since the refrigerant inlet port 6 and the refrigerant outlet port 7 of the liquid tank 14 are formed close to each other, the air-liquid capability of the liquid tank 14 becomes insufficient when the flow rate of the refrigerant R from the condenser 8 into the liquid tank 14 is fast.

Liquid tanks are also taught by, for example, Japanese Patent Disclosures Hei 2-267478, Hei 4-103973, Hei 5-66074 and Hei 8-183325.

A conventional liquid tank of another type will now be briefly explained with reference to FIGS. 17 and 18.

The liquid tank 15 shown in a partially cut-away sectional view in FIG. 17 and in plan view in FIG. 18 has a tank body 2, a flat type head section 3, desiccant 4 and a coolant takeoff tube 5.

The tank body 2, which is a slender cylinder tapered downward and closed at the bottom, is configured to hold the desiccant 4 at its middle section and pool refrigerant R at its bottom section.

The head section 3, which closes the upper opening of the tank body 2, is formed with a refrigerant inlet port 6, a refrigerant outlet port 7 and a center hole 17 fit with a transparent sight glass 16 to enable visual observation of the interior. As shown in FIG. 18, it is also provided with a pressure switch 18 and a fusible plug 19.

An inlet side connector flange 20 is provided at the refrigerant inlet port 6 and an outlet side connector flange 21 at the refrigerant outlet port 7 to enable introduction and extraction of the refrigerant.

The desiccant 4 absorbs and removes water entrained by the refrigerant R. The refrigerant R passes through the desiccant 4 and is pooled in the bottom section of the tank body 2, from where it passes out of the liquid tank 15 through the coolant takeoff tube 5.

Specifically, the coolant takeoff tube 5 is disposed along the axis of the liquid tank 15 and connected with the center hole 17 of the head section 3, from where it communicates with the refrigerant outlet port 7 through a lateral communicating hole 22 of the head section 3.

The outer end of the lateral communicating hole 22 is stopped with a bull plug 23.

The productivity of the liquid tank 15 is lowered by the need to machine the lateral communicating hole 22. An attempt has therefore been made to lower both material cost and machining cost by, as shown in the liquid tank 24 of FIG. 19, omitting the sight glass 16 and disposing the refrigerant outlet port 7 directly above the coolant takeoff tube 5, thereby eliminating the need to machine the lateral communicating hole 22.

In this case, however, functional and assembly considerations require installation of the coolant takeoff tube 5 at the center of the tank body 2. The location of the refrigerant outlet port 7 is therefore also limited to the center of the tank body 2 and, accordingly, to the center of the head section 3.

Locating the refrigerant outlet port 7 at the center of the head section 3 is disadvantageous, however, since it restricts the layout of the various other aforesaid components and holes that have to be mounted on or formed in the head section 3 and, as such, lowers the efficiency of the assembly and tube installation work. In the worst case, it may be impossible to find a workable layout and the idea of positioning the refrigerant outlet port 7 at the center will itself have to be abandoned.

Liquid tanks of this type are taught by, for example, Japanese Utility Model Disclosures Hei 3-27573 and Hei 6-14870.

Additional problems related to the conventional liquid tank 15 will now be explained with reference to FIGS. 20 to 23. FIG. 20 is a schematic plan view of the liquid tank 15 similar to FIG. 18, and FIG. 21 is a vertical sectional view thereof similar to FIG. 17.

As already pointed out, the liquid tank 15 has the problem of poor productivity owing to the need to machine the lateral communicating hole 22.

The liquid tank 24 shown in FIG. 22 and FIG. 23 (similar to FIG. 19) represents an attempt to overcome this problem by omitting the sight glass 16 and disposing the refrigerant outlet port 7 directly above the coolant takeoff tube 5, thereby eliminating the need to machine the lateral communicating hole 22 while also lowering material cost and machining cost.

In this case, however, functional and assembly considerations require installation of the coolant takeoff tube 5 at the center of the tank body 2. The location of the refrigerant outlet port 7 is therefore also limited to the center of the tank body 2 and, accordingly, to the center of the head section 3.

Locating the refrigerant outlet port 7 at the center of the head section 3 positions the refrigerant outlet port 7 near the refrigerant inlet port 6 and this location of both the refrigerant inlet port 6 and the refrigerant outlet port 7 toward one side of the head section 3 restricts the layout of the various other components and holes that have to be mounted on or formed in the head section 3 and, as such, lowers the efficiency of the assembly and tube installation work. In the worst case, it may be impossible to find a workable layout and the idea of positioning the refrigerant outlet port 7 at the center will itself have to be abandoned.

Liquid tanks of this type are taught by, for example, Japanese Patent Disclosures Sho 61-195256 and Hei 2-71067.

This invention was accomplished in light of the foregoing problems. One object of a first aspect of the invention is to provide a liquid tank that is of the type of the liquid tank 14 shown in FIG. 16 but that has excellent air-liquid separation capability.

Another object of the first aspect of the invention is to provide a liquid tank that is both easy to assemble and high in cost merit.

Another object of the first aspect of the invention is to provide a liquid tank that is of simple structure and excellent in mountability on a condenser.

Another object of the first aspect of the invention is to provide a liquid tank whose mountability on a condenser which utilizes a subcooling structure is excellent in terms of ease of returning refrigerant to the condenser.

One object of a second aspect of the invention is to provide a liquid tank that enables the refrigerant outlet port to be positioned at the center of the head section with minimal cost increase.

Another object of the second aspect of the invention is to provide a liquid tank that facilitates the layout of components at the head section by providing a degree of freedom in selecting the refrigerant outlet port machining position.

Another object of the second aspect of the invention is to provide a liquid tank that is excellent in assembly and fabrication property.

One object of a third aspect of the invention is to provide a liquid tank that enables the refrigerant outlet port to be positioned at the center of the head section with minimal cost increase.

Another object of the third aspect of the invention is to provide a liquid tank that enhances the freedom of laying out tubes and other components connected to the head section.

Another object of the third aspect of the invention is to provide a liquid tank that is excellent in assembly and fabrication property.

SUMMARY OF THE INVENTION

The first aspect of the invention is directed to a liquid tank of partially double-pipe structure including a tank body, a refrigerant inlet port section and a refrigerant outlet port section formed at a lower portion of the tank body, and a cylindrical partition formed inside the tank body as spaced from the inner wall of the tank body. Specifically, it provides a liquid tank that has a tank body and is connected to a condenser by the tank body to enable refrigerant to flow into the tank body from the condenser, undergo air-liquid separation, have water entrained thereby removed and pass to an evaporator, the liquid tank comprising a tank body, a refrigerant inlet port section formed at a lower portion of the tank body, a refrigerant outlet port section formed below the refrigerant inlet port section, and a cylindrical partition formed at a lower portion of the tank body to extend parallel to an inner wall of the tank body to above the height of the refrigerant inlet port section as spaced from the inner wall of the tank body by an induction space, the refrigerant inlet port section opening into the induction space and the refrigerant outlet port section communicating with a space enclosed by the cylindrical partition.

Desiccant can be disposed at an upper portion of the tank body.

Desiccant can be disposed in the space enclosed by the cylindrical partition.

One or more guide members for guiding the refrigerant from the refrigerant inlet port section upward in the tank body can be provided in the induction space.

The second aspect of the invention is directed to a liquid tank wherein a large-diameter port encompassing the refrigerant outlet port is formed in the head section and a joint is provided for connecting the refrigerant outlet port and the refrigerant takeoff tube. Specifically, it provides a liquid tank including a tank body having an upper opening, a head section closing the upper opening and formed with a refrigerant inlet port and a refrigerant outlet port, desiccant provided at a middle section of the tank body to pass refrigerant flowing in from the refrigerant inlet port, and a refrigerant takeoff tube disposed along an axis of the tank body to pass refrigerant that has passed through the desiccant and pooled at a lower portion of the tank body to the exterior through the refrigerant outlet port, the liquid tank comprising a large-diameter port encompassing the refrigerant outlet port formed on a side of the head section facing into the tank body and a joint for connecting the refrigerant takeoff tube to the large-diameter port.

The joint can be provided with a large-diameter portion to fit the large-diameter port so that air-tight communication can be established between the large-diameter port and the refrigerant takeoff tube by connecting the large-diameter portion of the joint and the large-diameter port.

The refrigerant takeoff tube can be provided with a large-diameter tube portion to fit the joint so that air-tight communication can be established between the large-diameter port and the refrigerant takeoff tube by connecting the large-diameter tube portion of the refrigerant takeoff tube and the joint.

The third aspect of the invention is directed to a liquid tank wherein the head section has the refrigerant outlet port formed at its center portion and multiple refrigerant inlet ports formed around the refrigerant outlet port so that a desired one of the refrigerant outlet ports can be selected as required by the layout. Specifically, it provides a liquid tank comprising a tank body having an upper opening, a head section closing the upper opening and formed with multiple refrigerant inlet ports and a refrigerant outlet port, desiccant provided at a middle section of the tank body to pass refrigerant flowing in from the refrigerant inlet port, and a refrigerant takeoff tube disposed along an axis of the tank body to pass refrigerant that has passed through the desiccant and pooled at a lower portion of the tank body to the exterior through the refrigerant outlet port, the refrigerant outlet port being disposed at a center portion of the head section and the multiple refrigerant inlet ports being disposed around the refrigerant outlet port.

In the liquid tank according to the first aspect of the invention, the refrigerant inlet port section and the refrigerant outlet port section are formed at a lower portion of the tank body and the cylindrical partition is provided inside the tank body to constitute a double-pipe structure inside the tank body. The outer wall portion of the cylindrical partition is spaced from the inner wall of the tank body to establish an induction space of, for example, annular shape.

Since the cylindrical partition extends to a height above the refrigerant inlet port section, refrigerant introduced into the induction space from the refrigerant inlet port section passes upward in the tank body along the outer wall portion of the cylindrical partition and can therefore reach the upper portion of the tank body. The refrigerant therefore undergoes air-liquid separation between the refrigerant inlet port section and the upper portion, whereafter the refrigerant liquid passes downward into the space enclosed by the cylindrical partition and the passes through this space to be led to the exterior through the refrigerant outlet port section.

The air-liquid separation capability of the liquid tank can therefore be enhanced by a simple configuration merely by providing the cylindrical partition inside the tank body, while also ensuring simple assembly and little or no cost increase.

The refrigerant inlet port section and the refrigerant outlet port section can be provided at any desired location at or below the cylindrical partition. Their locations can therefore be selected in light of such considerations as the structure of the condenser and the mounting points of other components.

The desiccant for absorbing and removing water from the refrigerant can be provided at the upper portion of the tank body, in the space enclosed by the cylindrical partition or at some other desired location.

In the liquid tank according to the second aspect of the invention, the large-diameter port encompassing the refrigerant outlet port is formed on the inner side of the head section to have a larger diameter than the refrigerant outlet port and the refrigerant outlet port is formed within the region of the large-diameter port. Freedom in the positioning the refrigerant outlet port on the head section can therefore be secured within the area of the large-diameter port.

The large-diameter port and the refrigerant takeoff tube are connected by a joint. Either the joint or the refrigerant takeoff tube is flared to match the diameter of the large-diameter port. A communication passage can therefore be established from the refrigerant takeoff tube through the joint and the large-diameter port to the refrigerant outlet port.

With this arrangement, the position of the refrigerant outlet port can be offset somewhat in the vicinity of the center of the head section while maintaining the refrigerant takeoff tube in alignment with the axis of the tank body. This eliminates the need to machine the lateral communicating hole required by the prior art, reduces the number of components and machining steps, enables the machining and assembly to be carried out with increased freedom, and lowers cost.

In the liquid tank according to the third aspect of the invention, multiple refrigerant inlet ports are disposed around the refrigerant outlet port disposed at the center portion of the head section. Since a desired one of the multiple refrigerant inlet ports can be selected as the actual refrigerant inlet port in light of the engine room or the like where the air-conditioning equipment is installed, the work of connecting tubes to the liquid tank can be conducted without loss of efficiency.

Since the refrigerant inlet port or ports other than the selected one can be closed by a fusible plug, pressure switch, relief valve or other functional component having a seal section of the same configuration as that of a tube connector, the number of cutting tool types needed to machine attachment holes for the different components can be reduced and the number of processing steps can be decreased with little or no increase in number of components.

Since the third aspect of the invention therefore enables a single type of liquid tank to be used with different types of air-conditioning equipment and the hole machining to be conducted in the same manner for all liquid tanks, it lowers cost and increases tubing layout freedom.

DETAILED DESCRIPTION OF THE PREFERRED EMBODIMENTS

A liquid tank 30 that is a first embodiment of the invention (first aspect) will now be explained with reference to FIGS. 1 and 2. Members like those in FIGS. 14 to 23 are assigned like symbols to those in FIGS. 14 to 23 and will not be explained again here.

Figure 1:
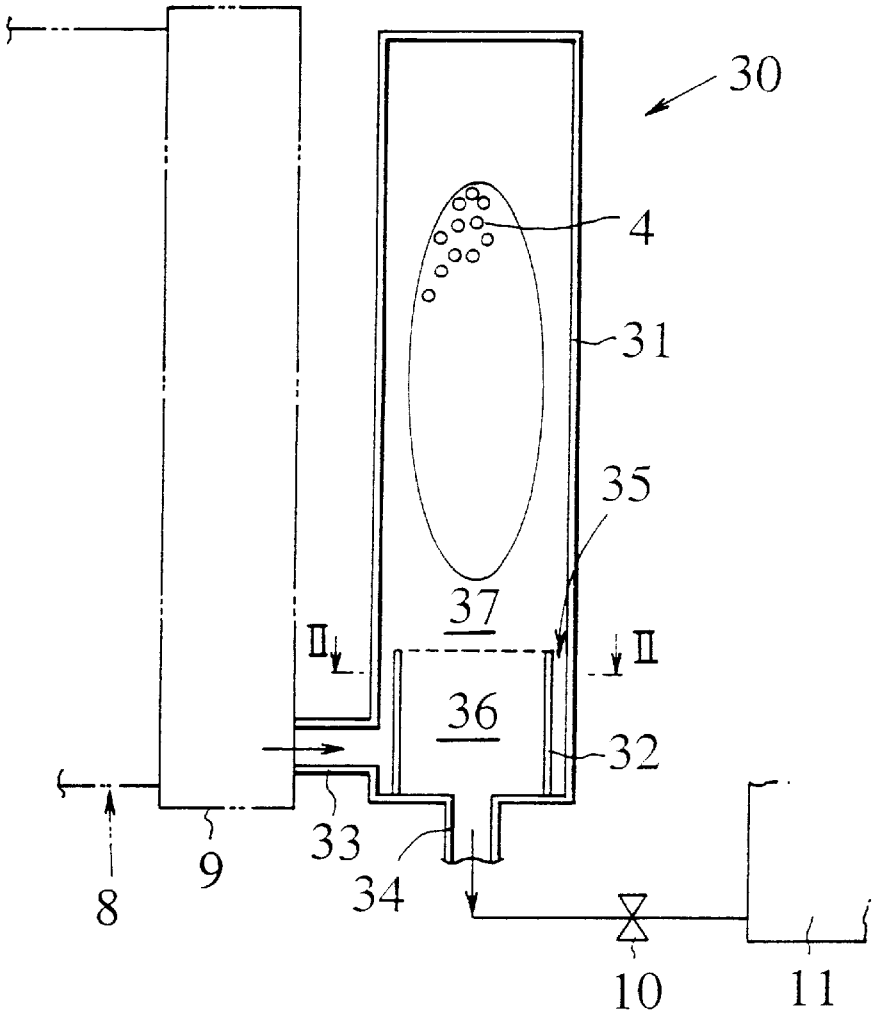
FIG. 1 is a vertical sectional view of a liquid tank 30 that is a first embodiment of the invention (first aspect).
Figure 2:
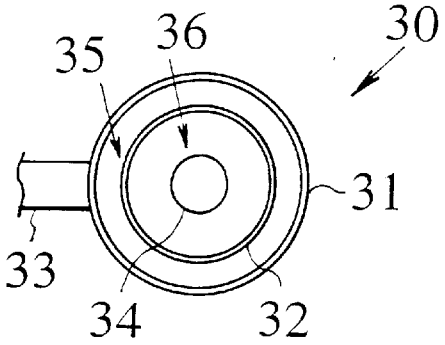
FIG. 2 is a sectional view taken along line II—II in FIG. 1.

FIG. 1 is a vertical sectional view of the liquid tank 30 and FIG. 2 is a sectional view thereof taken along line II—II in FIG. 1. The liquid tank 30 has a tank body 31 corresponding to the aforesaid tank body 2, a cylindrical partition 32, and desiccant 4.

The tank body 31 is a cylindrical body closed at the top and bottom. It is formed at a lower portion thereof with a refrigerant inlet port section 33 corresponding to the aforesaid refrigerant inlet port 6 and below the refrigerant inlet port section 33 (at the bottom section of the tank body 31) with a refrigerant outlet port section 34.

The desiccant 4 is disposed above the cylindrical partition 32.

The cylindrical partition 32 is constituted as a cylindrical member spaced from an inner wall portion of the tank body 31 so as to form an annular induction space 35 between itself and the inner wall portion of the tank body 31. It extends upward to above the height of the refrigerant inlet port section 33.

The refrigerant inlet port section 33 faces into the induction space 35 and the space enclosed by the cylindrical partition 32 forms a liquid pooling space 36 that communicates with the refrigerant outlet port section 34. The region above cylindrical partition 32 and the liquid pooling space 36 is an air-liquid separating space 37.

In the liquid tank 30 of this configuration, refrigerant R flowing from the condenser 8 into the induction space 35 through the refrigerant inlet port section 33 collides with the outer wall portion of the cylindrical partition 32. Part of it then passes upward along this outer wall portion and the remainder circles around to the rear of the outer wall portion and passes upward after colliding with the inner wall portion of the tank body 31.

As the refrigerant R passes upward through the induction space 35 and the air-liquid separating space 37 it undergoes air-liquid separation and only liquid refrigerant R pools in the liquid pooling space 36, from where it passes through the refrigerant outlet port section 34 and the expansion valve 10 to the evaporator 11.

Figure 15:
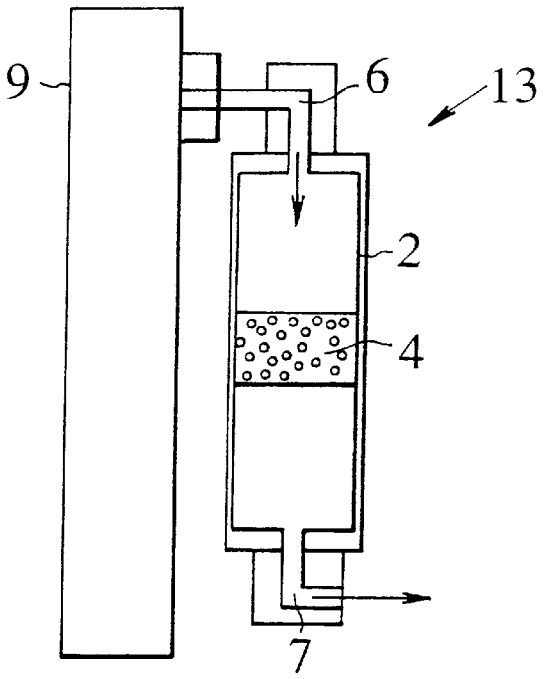
Fig. 15 Prior Art
FIG. 15 is a vertical sectional view schematically illustrating another conventional liquid tank 13.
Figure 16:
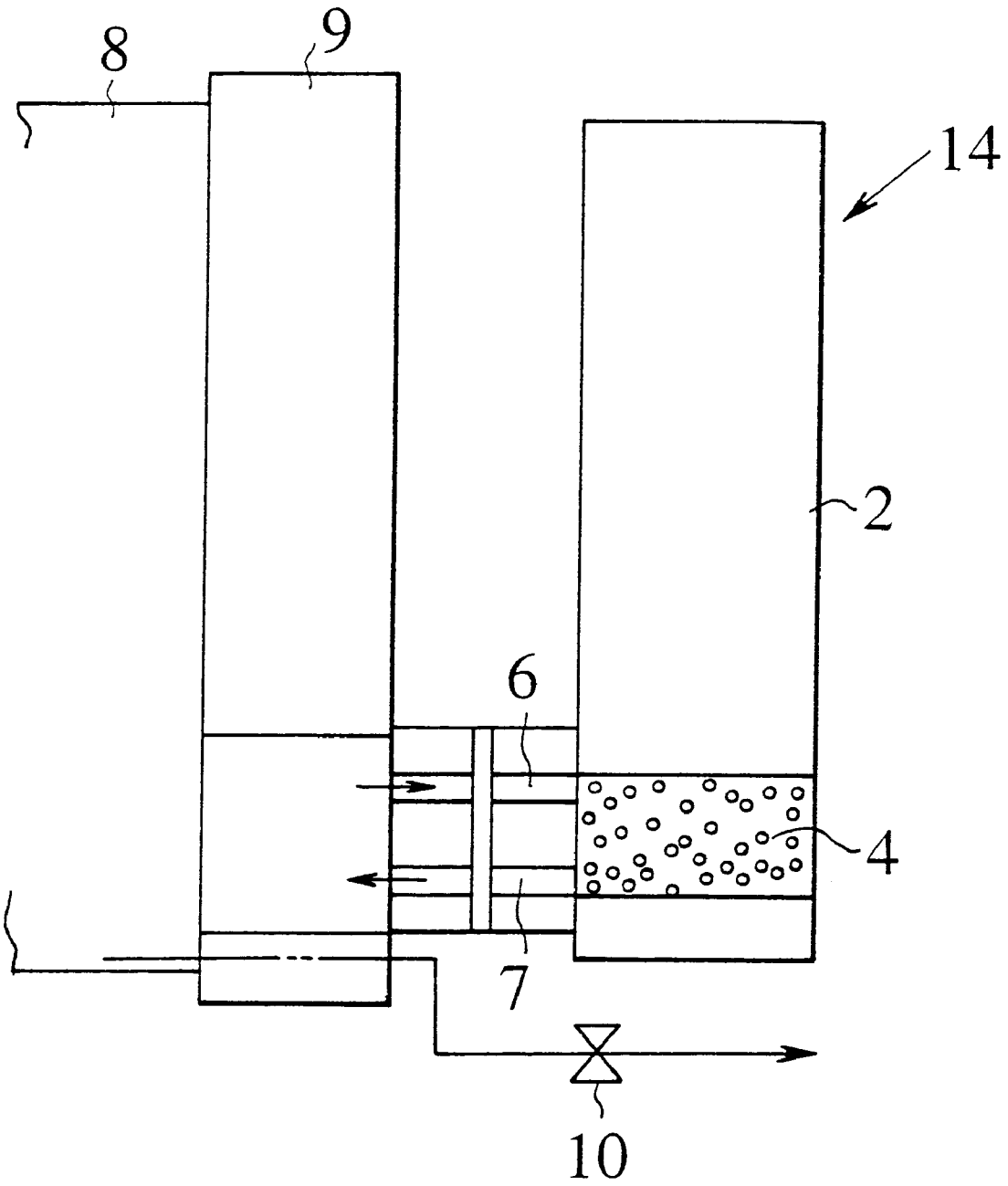
Fig. 16 Prior Art
FIG. 16 is a vertical sectional view schematically illustrating another conventional liquid tank 14.

The liquid tank 30 can therefore achieve the same effect of water removal by the desiccant 4 as when the refrigerant R is introduced from the top of the tank body 2 in the conventional liquid tank 1 (FIG. 14) or liquid tank 13 (FIG. 15).

The liquid tank 30 can be constituted integrally with the condenser 8 (with the outlet side tank 9 of the condenser 8) or be constituted as a subassembly thereof.

Figure 3:
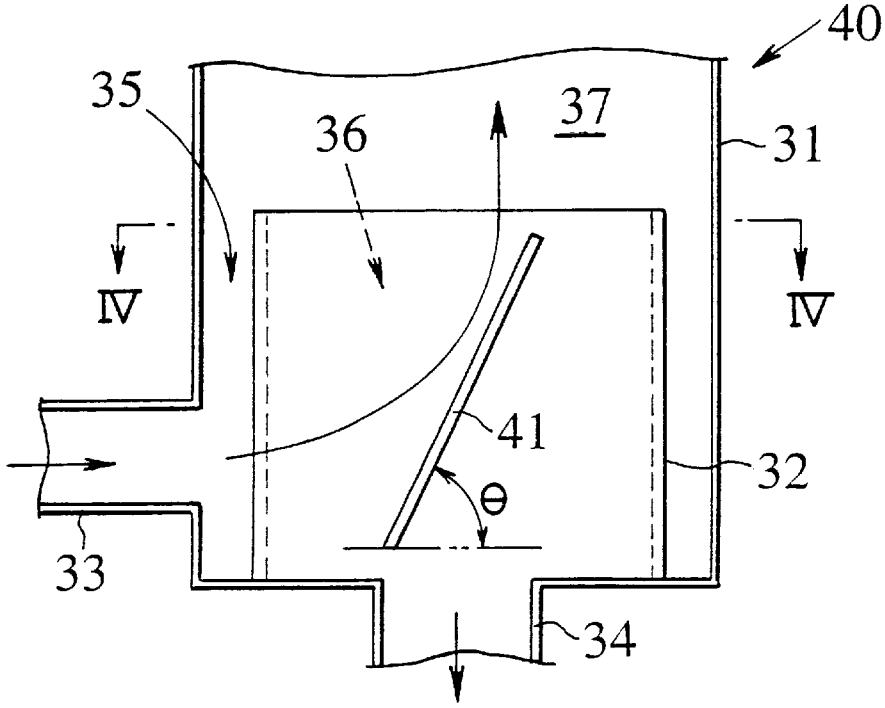
FIG. 3 is a sectional view schematically illustrating an essential portion of a liquid tank 40 that is a second embodiment of the invention (first aspect).
Figure 4:
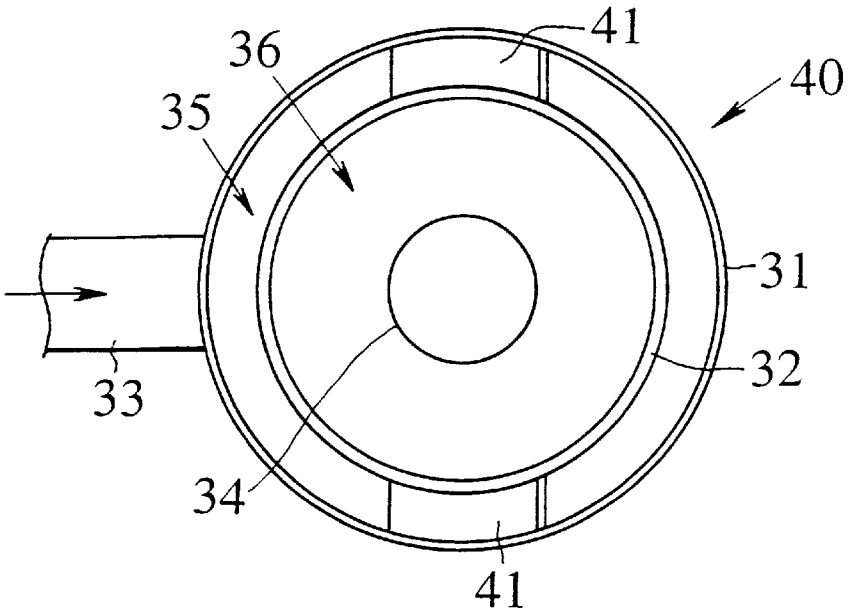
FIG. 4 is a sectional view taken along line IV—IV in FIG. 3.

FIG. 3 is a sectional view schematically illustrating an essential portion of a liquid tank 40 that is a second embodiment of the invention (first aspect), and FIG. 4 is a sectional view taken along line IV—IV in FIG. 3. The liquid tank 40 is provided with a pair of radially extending guide members 41 attached aslant at a prescribed inclination angle θ to the periphery of the cylindrical partition 32 at positions facing the refrigerant inlet port section 33.

In the liquid tank 40 of this configuration, since the guide members 41 provided in the induction space 35 face the refrigerant inlet port section 33, the refrigerant R from the refrigerant inlet port section 33 is guided upward upon colliding with the guide members 41. The refrigerant R can therefore be efficiently guided from the induction space 35 toward the air-liquid separating space 37.

Figure 5:
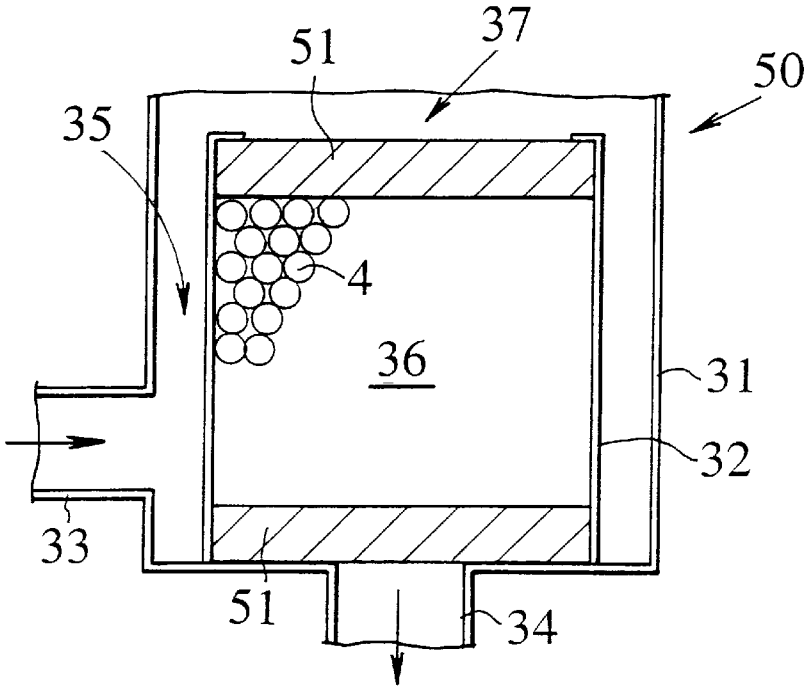
FIG. 5 is a sectional view schematically illustrating an essential portion of a liquid tank 50 that is a third embodiment of the invention (first aspect).

FIG. 5 is a sectional view schematically illustrating an essential portion of a liquid tank 50 that is a third embodiment of the invention (first aspect). In the liquid tank 50, the desiccant 4 is held in a region of the liquid pooling space 36 and filters 51 are provided above and below this region.

In the liquid tank 50 of this configuration, water is not removed in the air-liquid separating space 37 but is instead absorbed and removed with enhanced efficiency in the liquid pooling space 36.

Figure 6:
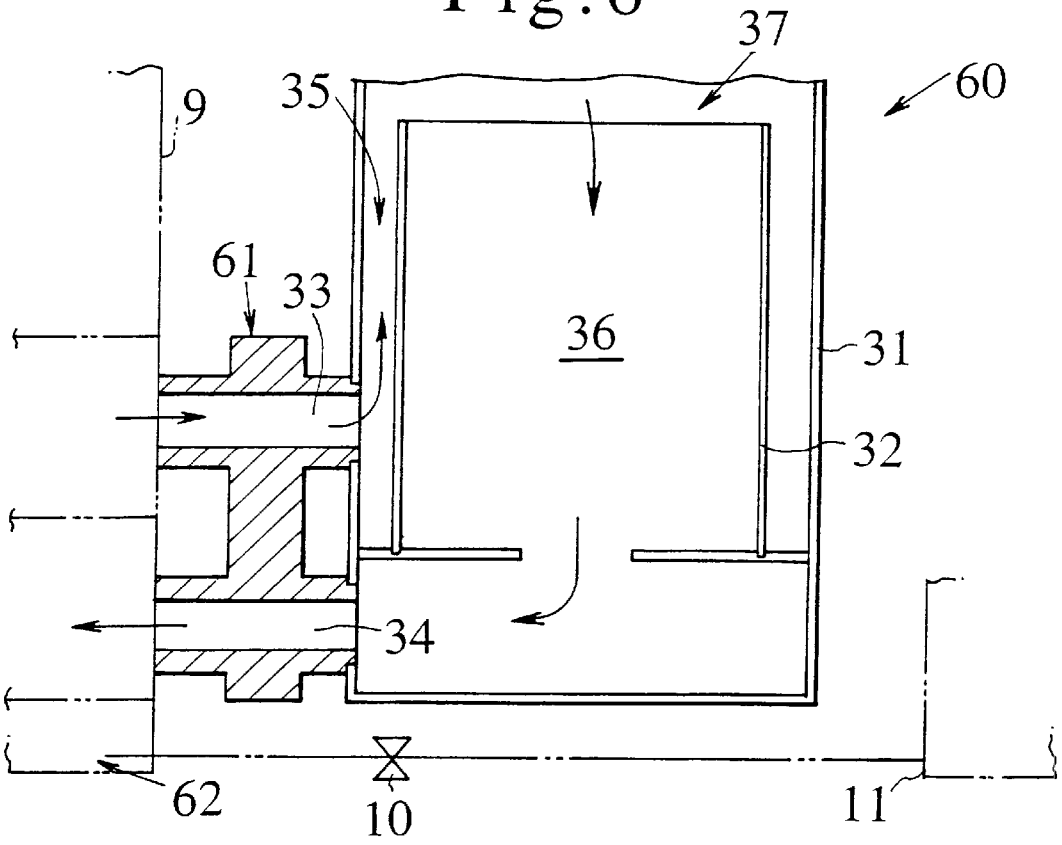
FIG. 6 is a sectional view schematically illustrating an essential portion of a liquid tank 60 that is a fourth embodiment of the invention (first aspect).

FIG. 6 is a sectional view schematically illustrating an essential portion of a liquid tank 60 that is a fourth embodiment of the invention (first aspect). In the liquid tank 60, the refrigerant inlet port section 33 and the refrigerant outlet port section 34 extend in parallel and are joined into a connector 61 for connection to the outlet side tank 9 of the condenser 8.

With this arrangement, the refrigerant R can be returned to a subcooling section 62 of the condenser 8 to be subcooled before being supplied to the expansion valve 10 and the evaporator 11.

The liquid tank 60 can be constituted integrally with the condenser 8 (with the outlet side tank 9 of the condenser 8) or be constituted as a subassembly thereof.

Since the liquid tank 60 of this configuration has the refrigerant inlet port section 33 and the refrigerant outlet port section 34 joined into the connector 61, it is easy to mount on the condenser 8.

A liquid tank 70 that is a fifth embodiment of the invention (second aspect) will now be explained with reference to FIG. 7.

Figure 7:
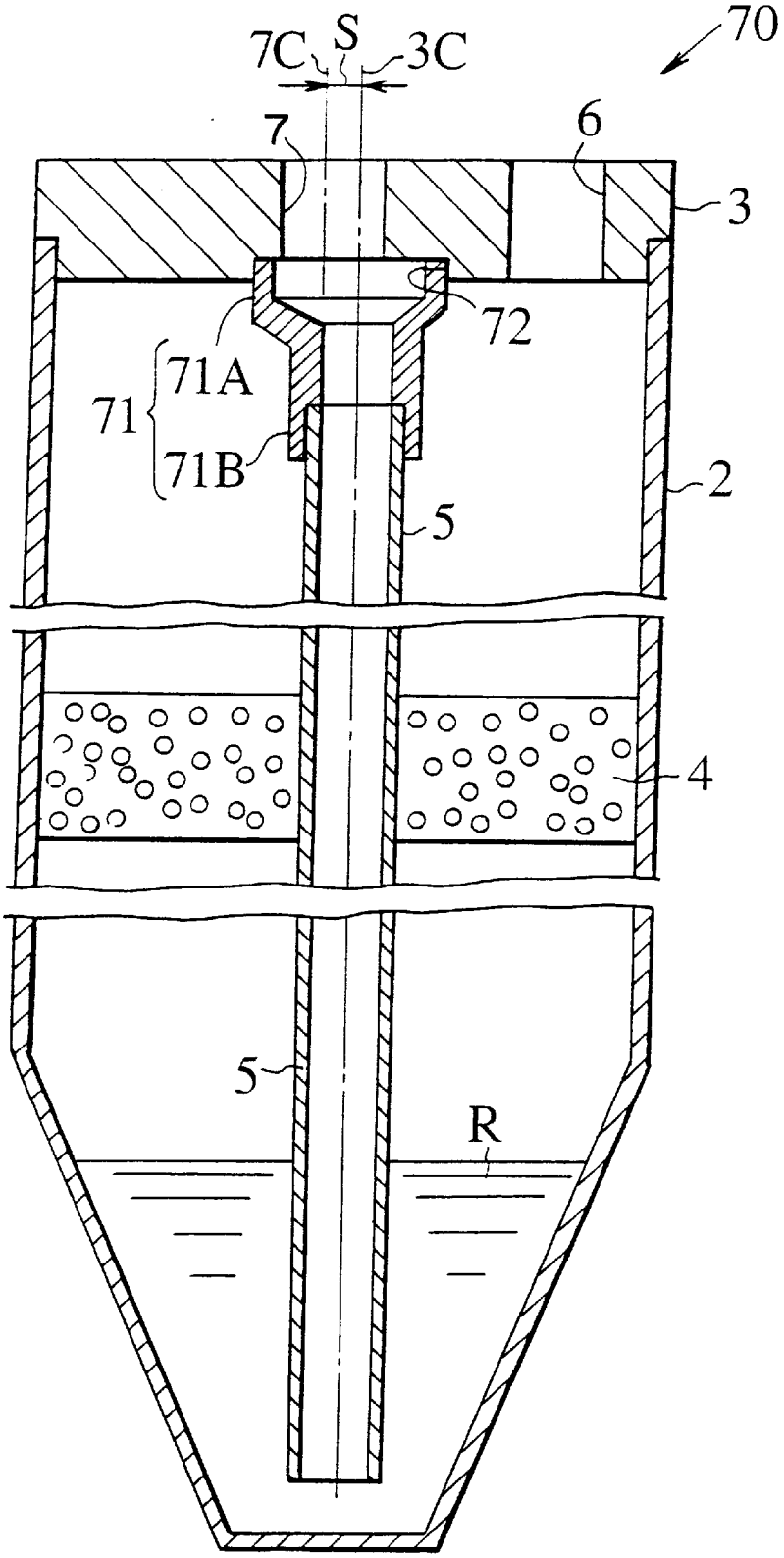
FIG. 7 is partially cut-away sectional view of a liquid tank 70 that is a fifth embodiment of the invention (second aspect).
Figure 17:
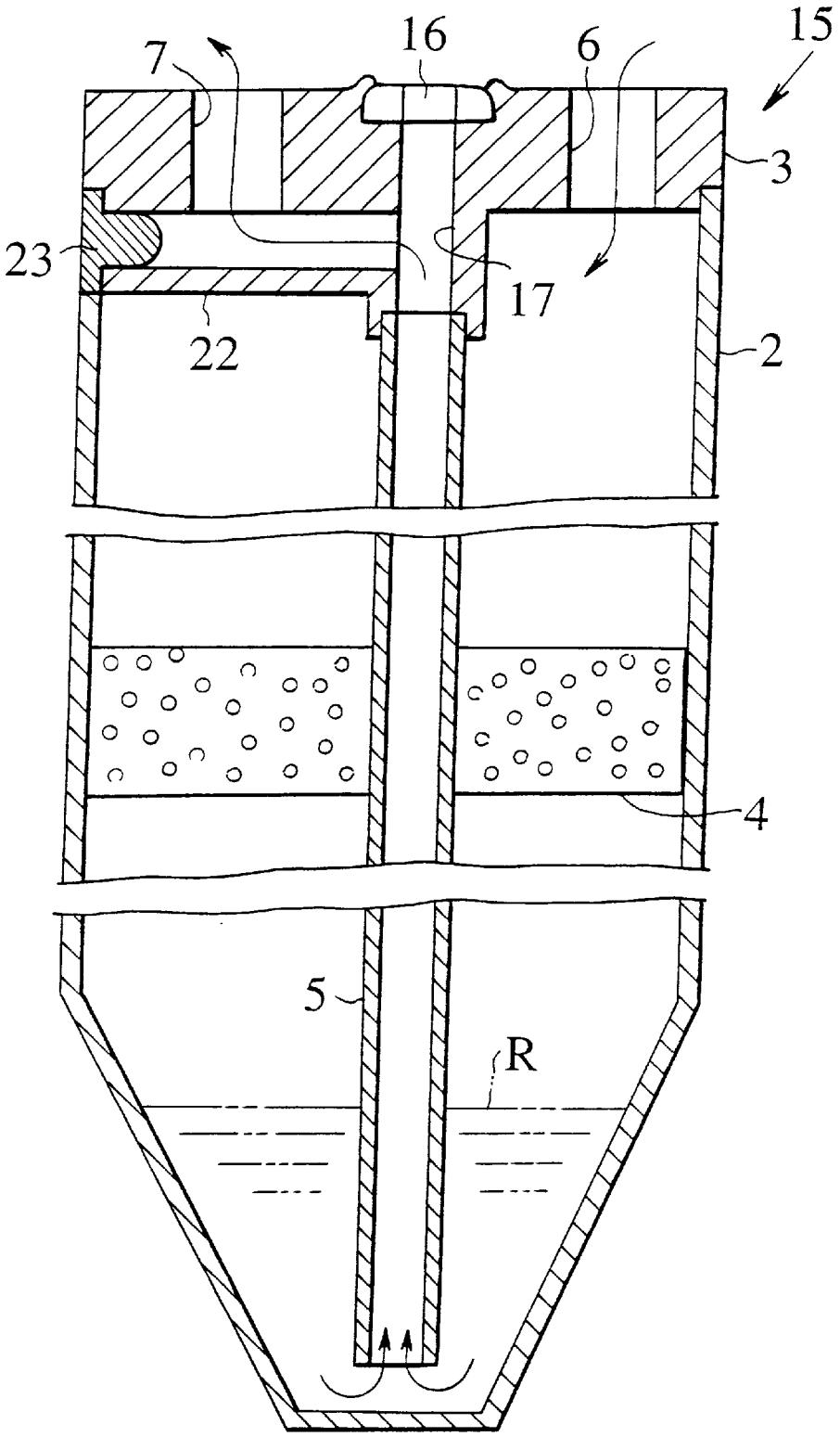
Fig. 17 Prior Art
FIG. 17 is a partially cut-away sectional of a liquid tank 15 of another conventional type.
Figure 18:
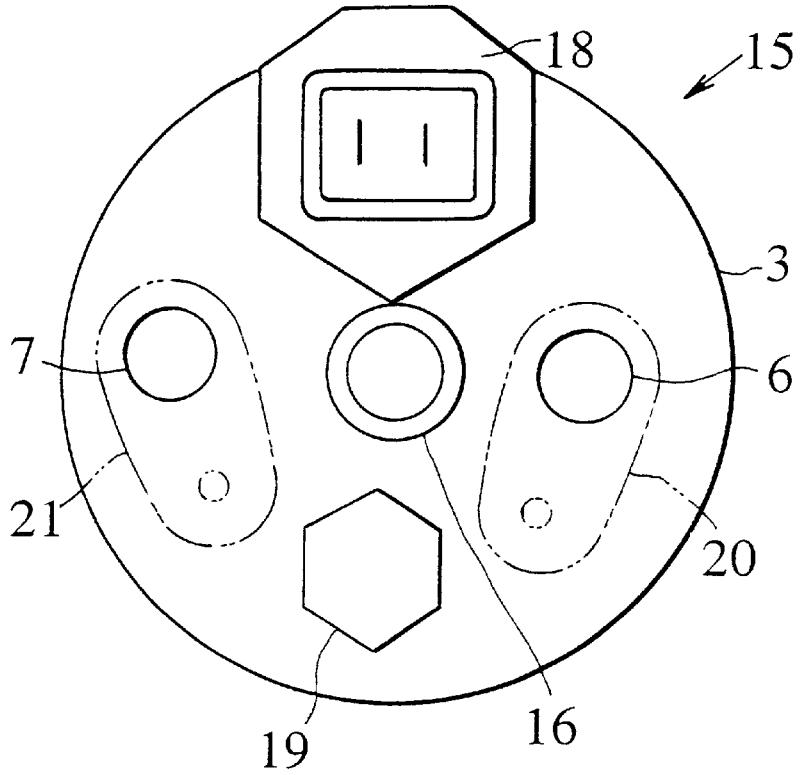
Fig. 18 Prior Art
FIG. 18 is a plan view of the liquid tank 15 of FIG. 17.
Figure 19:
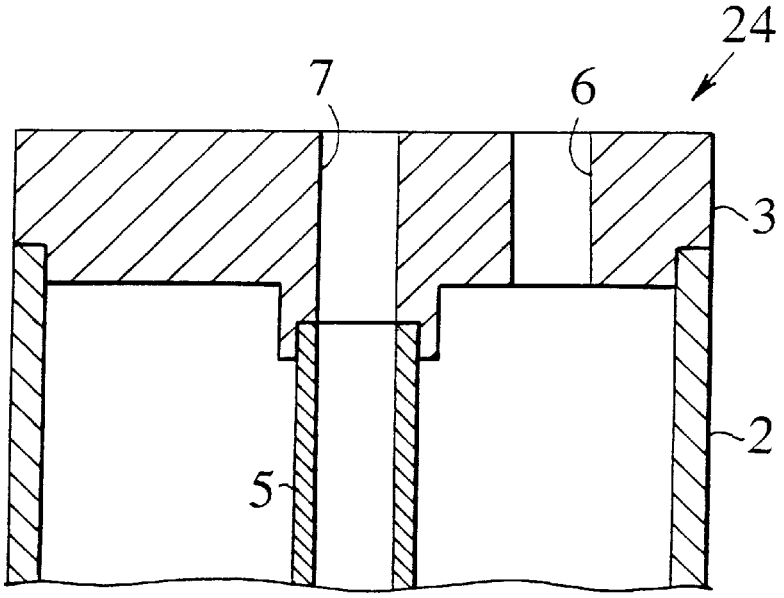
Fig. 19 Prior Art
FIG. 19 is partially cut-away sectional view of a liquid tank 24 from which the sight glass 16 and the lateral communicating hole 22 of the liquid tank 15 of FIG. 17 are omitted.
Figure 20:
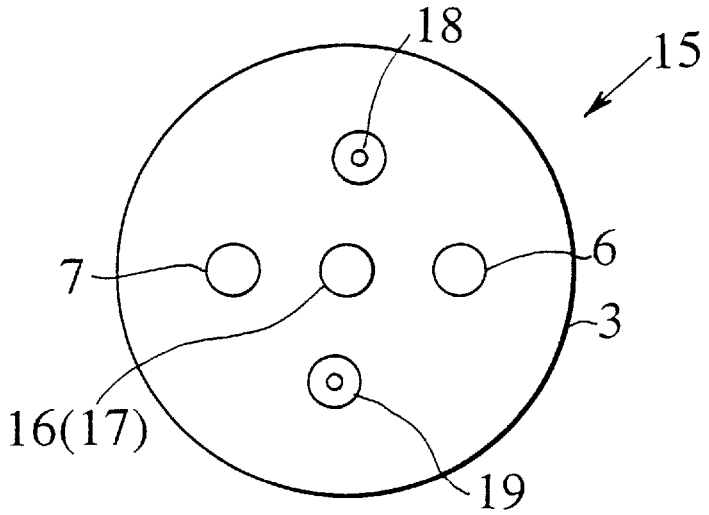
Fig.20 Prior Art
FIG. 20 is a plan view similar to FIG. 18 schematically showing the conventional liquid tank 15.
Figure 21:
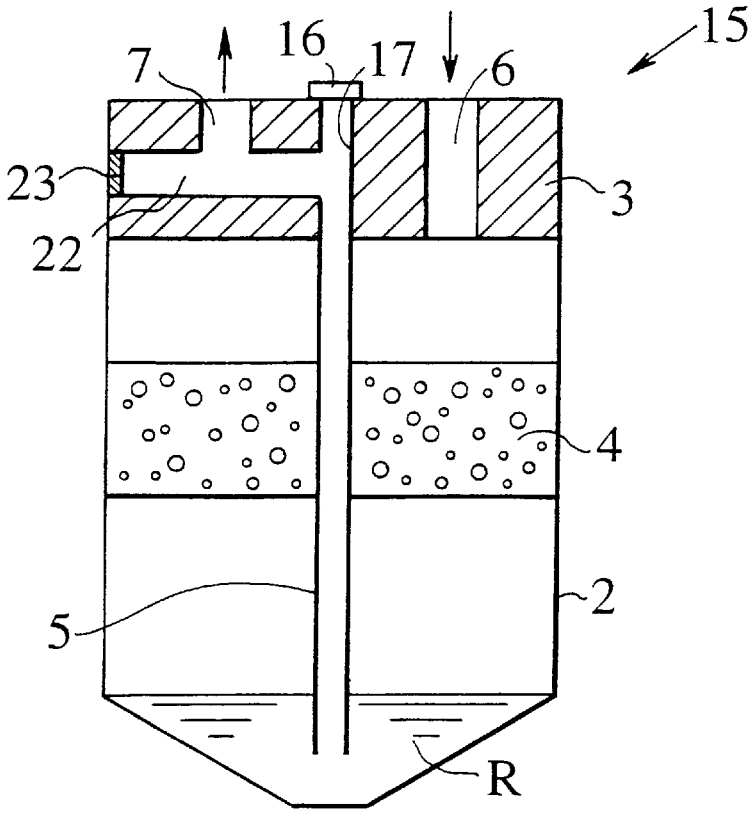
Fig.21 Prior Art
FIG. 21 is a vertical sectional view similar to FIG. 17.
Figure 22:
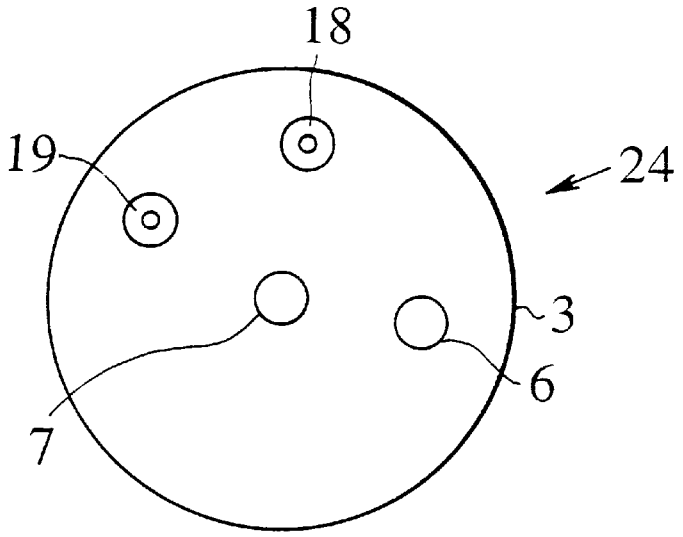
Fig.22 Prior Art
FIG. 22 is a plan view of another conventional liquid tank 24.
Figure 23:
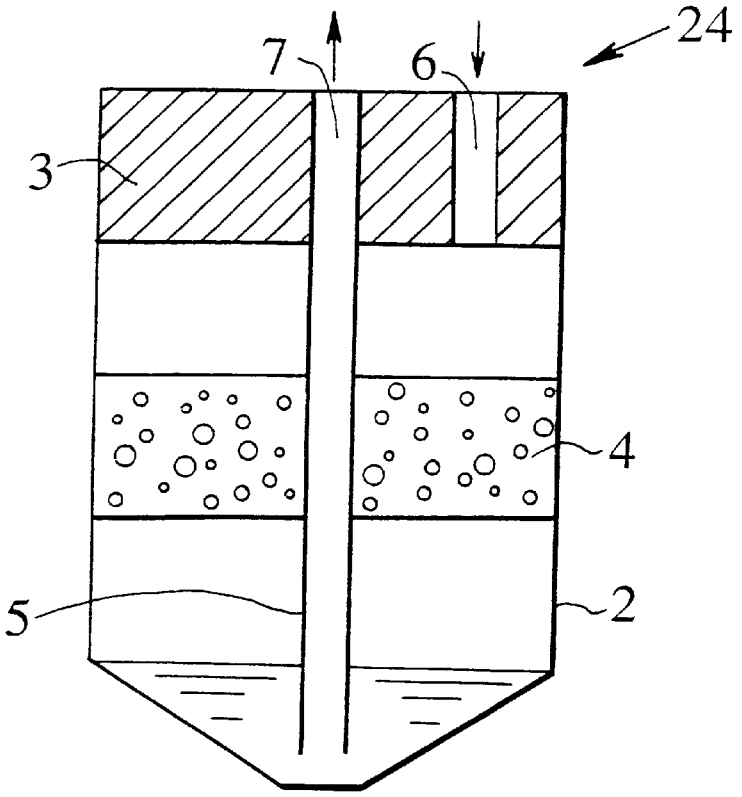
Fig.23 Prior Art
FIG. 23 is a vertical sectional view of the liquid tank 24 of FIG. 22.

FIG. 7 is partially cut-away sectional view of the liquid tank 70. In the liquid tank 70, the head section 3 and the refrigerant takeoff tube 5 are connected by a joint 71. The sight glass 16, the lateral communicating hole 22 and the bull plug 23 are eliminated, and the refrigerant outlet port 7 is disposed in the vicinity of the center of the head section 3. Other aspects of the structure are substantially the same as those of the liquid tank 15 (FIG. 17).

A large-diameter port 72 is formed on the inside of the head section 3 (side facing into the tank body 2) to have its center aligned with the axis 3C of the head section 3 (which is also the axis of the tank body 2 and the refrigerant takeoff tube 5). The large-diameter port 72 is formed to have a larger diameter than the refrigerant outlet port 7, and the refrigerant outlet port 7 is formed at the outer surface of the head section 3 to lie within the region of the large-diameter port 72.

The refrigerant outlet port 7 can be formed to have its axis 7C lie apart from the axis 3C by a prescribed offset distance S, whereby the radius can be freely selected within the range of the offset distance S.

Since the center of the refrigerant outlet port 7 can, for example, be offset from the axis of the refrigerant takeoff tube 5 (the axis 3C of the head section 3) in a direction away from the refrigerant inlet port 6, this fifth embodiment is advantageous from the point of layout design.

The joint 71 has a large-diameter portion 71A for connection with the large-diameter port 72 and a straight-tube section 71B for connection with the refrigerant takeoff tube 5, whereby air-tight connection can be established between the large-diameter port 72 and the large-diameter portion 71A and between the straight-tube section 71B and the refrigerant takeoff tube 5.

In the liquid tank 70 of this configuration, the refrigerant takeoff tube 5 and the refrigerant outlet port 7 can be connected by the joint 71 with a degree of eccentricity within the range of the offset distance S. The desiccant 4 introduced into the tank body 2 through the refrigerant inlet port 6 can therefore be dried by the desiccant 4, progress to the refrigerant takeoff tube 5 at the bottom section of the tank body 2, and pass through the joint 71 and the refrigerant outlet port 7 to the exterior.

In addition, the refrigerant outlet port 7 can be formed in the head section 3 either in alignment with the axis 3C or as offset therefrom by, at maximum, the offset distance S.

This provides freedom in the positioning of the refrigerant outlet port 7 relative to the head section 3, eliminates the need to provide the sight glass 16 and other components in the head section 3, eliminates processing steps such as for machining of the lateral communicating hole 22, and lowers cost.

In this aspect of the invention, the refrigerant outlet port 7 and the refrigerant takeoff tube 5 can be connected in any of various ways.

Figure 8:
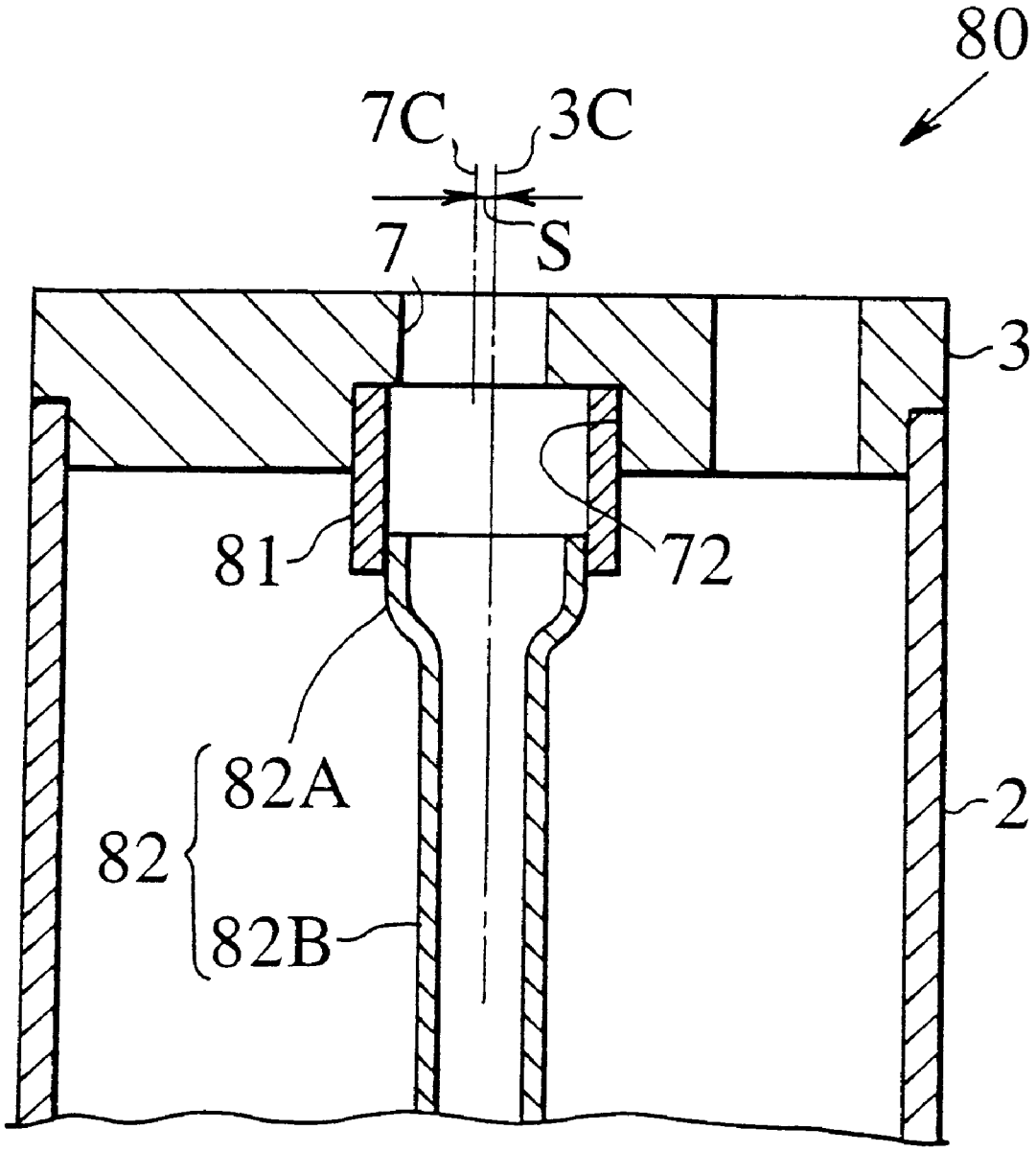
FIG. 8 is partially cut-away sectional view of a liquid tank 80 that is a sixth embodiment of the invention (second aspect).

One example is shown in FIG. 8, which is a partially cut-away sectional view of a liquid tank 80 that is a sixth embodiment of the invention (second aspect). In the liquid tank 80, the head section 3 is formed with a large-diameter port 72 similar to that of the liquid tank 70 (FIG. 7) and a joint 81 of straight tubular shape is air-tightly fixed to the large-diameter port 72.

A refrigerant take-off tube 82 corresponding to the refrigerant takeoff tube 5 comprises a large-diameter tube portion 82A that air-tightly connects with the joint 81 and a straight-tube portion 82B that extends to the bottom section of the tank body 2.

Like the liquid tank 70, the liquid tank 80 of this configuration also enables the position of the refrigerant outlet port 7 to be freely selected within the range of the large-diameter port 72 and the joint 81 and further enables the connection between the refrigerant take-off tube 82 and the refrigerant outlet port 7 to be effected smoothly and reliably.

A liquid tank 90 that is a seventh embodiment of the invention (third aspect) will now be explained with reference to FIGS. 9 to 11.

Figure 9:
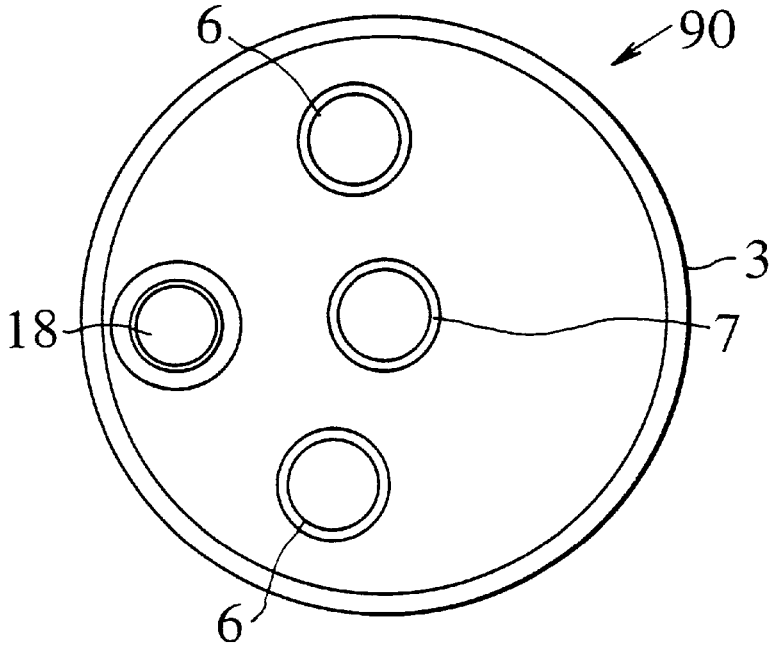
FIG. 9 is a plan view of a liquid tank 90 that is a seventh embodiment of the invention (third aspect).

FIG. 9 is a plan view of the liquid tank 90. In the liquid tank 90, multiple (two in the illustrated example) refrigerant inlet ports 6 are disposed at prescribed angular intervals around the refrigerant outlet port 7 disposed at the center portion of the head section 3.

The pressure switch 18 mentioned earlier is also provided.

One of the two refrigerant inlet ports 6 of the so-configured liquid tank 90 is selected as the actual refrigerant inlet port 6 based on layout conditions related to the liquid tank 90, and the other refrigerant inlet port 6 can be used to attach a fusible plug 91 corresponding to the fusible plug 19.

Figure 10:
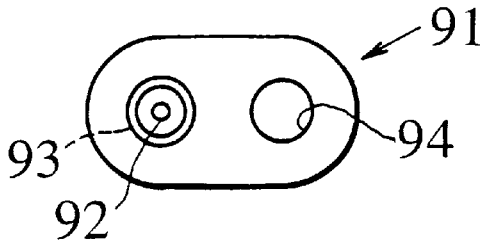
FIG. 10 is a plan view showing an example of a fusible plug 91 of the liquid tank 90.
Figure 11:
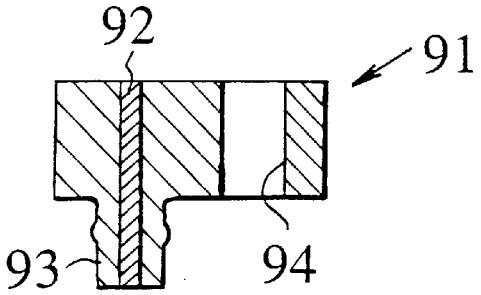
FIG. 11 is a vertical sectional view of the fusible plug 91 of FIG. 10.

FIG. 10 is a plan view showing an example of the fusible plug 91 and FIG. 11 is a vertical sectional view thereof. The fusible plug 91 has an attachment portion 93 having a fusible portion 92 and a bolt hole 94.

One of the two refrigerant inlet ports 6 is selected as the actual refrigerant inlet port 6, the attachment portion 93 of the fusible plug 91 is inserted in the other refrigerant inlet port 6, and the fusible plug 91 is fixed in place by passing a fastening bolt (not shown) passed through the bolt hole 94 and screwing it into a fastening hole (not shown) of the head section 3.

The freedom in attachment layout can thus be doubled.

Figure 12:
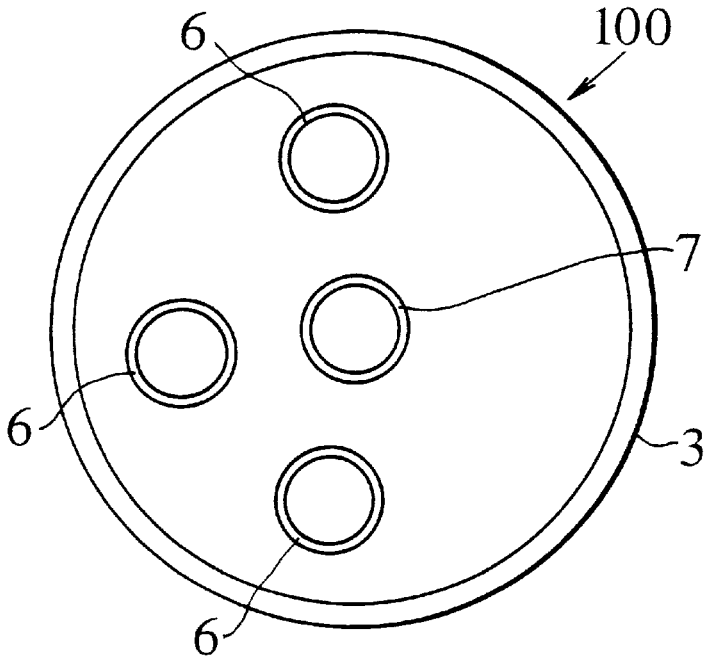
FIG. 12 is a plan view of a liquid tank 100 that is an eighth embodiment of the invention (third aspect).

FIG. 12 is a plan view of a liquid tank 100 that is an eighth embodiment of the invention (third aspect). In the liquid tank 100, multiple (three in the illustrated example) refrigerant inlet ports 6 are disposed at prescribed angular intervals around the refrigerant outlet port 7 disposed the center portion of the head section 3.

One of the three refrigerant inlet ports 6 of the so-configured liquid tank 100 is selected as the actual refrigerant inlet port 6 and the other two refrigerant inlet ports 6 can be used as attachment holes for the fusible plug 91 and the pressure switch 18.

Figure 13:
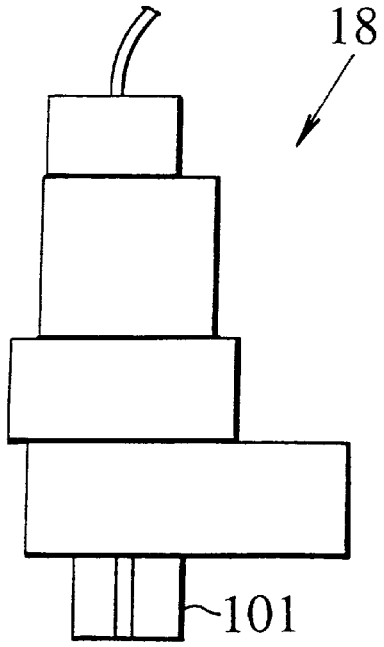
FIG. 13 is a side view of an example of a pressure switch 18 of the liquid tank 100.
Figure 14:
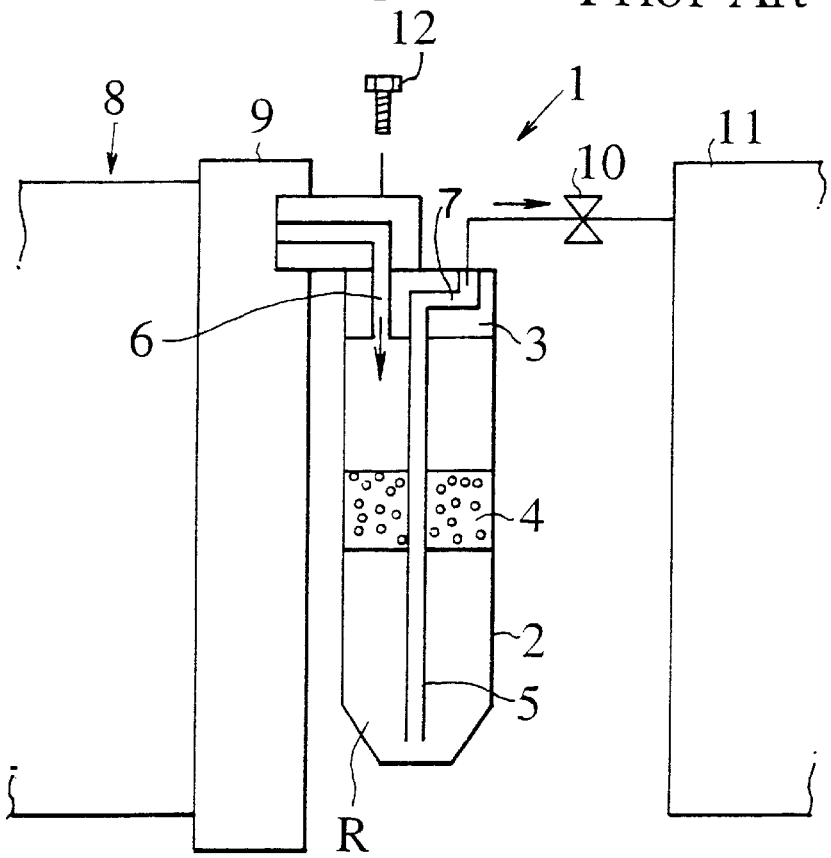
Fig. 14 Prior Art
FIG. 14 is a vertical sectional view schematically illustrating a conventional liquid tank 1.

FIG. 13 is a side view of an example of a pressure switch 18 of the liquid tank 100. The pressure switch 18 can be fixed in place by inserting an attachment portion 101 thereof into one of the refrigerant inlet ports 6.

The freedom in attachment layout can thus be trebled.

As explained in the foregoing, the first aspect of the invention provides the cylindrical partition in the tank body, thereby enabling air-liquid separation to be effected in the induction space and the air-liquid separating space using a liquid tank that is simple in structure and inexpensive to fabricate.

The second aspect of the invention forms the large-diameter port on the inside of the head section and connects the refrigerant outlet port and the refrigerant takeoff tube by a joint. It therefore increases the degree of design freedom regarding positioning of the refrigerant outlet port and also lowers liquid tank fabrication cost.

The third aspect of the invention provides multiple refrigerant inlet ports around the refrigerant outlet port disposed at the center portion of the head section, thereby enhancing layout freedom and lowering cost.

What is claimed is:

1. A liquid tank which has a tank body and is connected to a condenser by the tank body to enable refrigerant to flow into the tank body from the condenser, undergo air-liquid separation, have water entrained thereby removed and pass to an evaporator, the liquid tank comprising:

a tank body, a refrigerant inlet port section formed at a lower portion of the tank body, a refrigerant outlet port section formed below the refrigerant inlet port section, and a cylindrical partition formed at a lower portion of the tank body to extend parallel to an inner wall of the tank body to above the height of the refrigerant inlet port section as spaced from the inner wall of the tank body by an induction space, the refrigerant inlet port section opening into the induction space and the refrigerant outlet port section communicating with a space enclosed by the cylindrical partition.

2. A liquid tank according to claim 1, further comprising desiccant disposed at an upper portion of the tank body.

3. A liquid tank according to claim 1, further comprising desiccant disposed in the space enclosed by the cylindrical partition.

4. A liquid tank according to claim 1, wherein the induction space is annular.

5. A liquid tank according to claim 1, wherein the space enclosed by the cylindrical partition constitutes a liquid pooling space, the refrigerant outlet port section communicates with the liquid pooling space, and an upper portion of the tank body above the liquid pooling space constitutes an air-liquid separating space.

6. A liquid tank according to claim 1, wherein at least one guide member for guiding the refrigerant from the refrigerant inlet port section upward in the tank body is provided in the induction space.

7. A liquid tank according to claim 1, wherein the space enclosed by the cylindrical partition constitutes a liquid pooling space, desiccant is held in a region of the liquid pooling space and filters are provided above and below this region.

8. A liquid tank according to claim 1, wherein the refrigerant inlet port section and the refrigerant outlet port section extend in parallel and are joined into a connector for connection to an outlet side tank of the condenser.

* * * * *